US012292052B2

(12) United States Patent
Rinaldi et al.

(10) Patent No.: US 12,292,052 B2
(45) Date of Patent: May 6, 2025

(54) COMPRESSOR MODULE AND ELECTRIC-MOTOR-DRIVEN REFRIGERANT COMPRESSOR

(71) Applicant: Brose Fahrzeugteile SE & Co. Kommanditgesellschaft, Würzburg, Würzburg (DE)

(72) Inventors: Budi Rinaldi, Frankfurt am Main (DE); Björn Fagerli, Rodheim (DE)

(73) Assignee: BROSE Fahrzeugteile SE & Co. Kommanditgesellschaft, Würzburg, Würzburg (DE)

( * ) Notice: Subject to any disclaimer, the term of this patent is extended or adjusted under 35 U.S.C. 154(b) by 207 days.

(21) Appl. No.: 18/080,894

(22) Filed: Dec. 14, 2022

(65) Prior Publication Data

US 2023/0113193 A1 Apr. 13, 2023

Related U.S. Application Data

(63) Continuation of application No. PCT/EP2021/065911, filed on Jun. 14, 2021.

(30) Foreign Application Priority Data

Jun. 17, 2020 (DE) ..... 10 2020 207 510.7

(51) Int. Cl.
*F04C 29/02* (2006.01)

(52) U.S. Cl.
CPC ..... *F04C 29/026* (2013.01)

(58) Field of Classification Search
CPC ..... F04C 29/02; F04C 29/023; F04C 29/025; F04C 29/026; F04C 29/028; F25B 43/02
See application file for complete search history.

(56) References Cited

U.S. PATENT DOCUMENTS 9,828,997 B2 11/2017 Kawano
2001/0029727 A1* 10/2001 Iwanami ..... F04C 29/026 55/467

(Continued)

FOREIGN PATENT DOCUMENTS

CN 101517239 A 8/2009
DE 102018212802 A1 2/2020

(Continued)

*Primary Examiner* — Mark A Laurenzi
*Assistant Examiner* — Xiaoting Hu
(74) *Attorney, Agent, or Firm* — Laurence A. Greenberg; Werner H. Stemer; Ralph E. Locher

(57) ABSTRACT

A compressor module has a compressor housing with a high-pressure chamber and an outlet for a compressed refrigerant, and a separation device, accommodated in the compressor housing, for separating out a lubricant mixed with the refrigerant. The separation device has a hollow-cylindrical separation portion and a funnel-shaped outlet portion for the refrigerant, which outlet portion protrudes into the hollow-cylindrical separation portion, forming an annular space. The separation device, by use of a portion end of the separation portion, sits inside a receptacle in the compressor housing, which receptacle is connected to a lubricant reservoir. The separation device, by means of the outlet portion, at least partially sits inside the outlet. The separation device is securely held in the compressor housing by an interlocking connection such that it is prevented from twisting and/or axial displacement.

12 Claims, 6 Drawing Sheets

(56) References Cited

U.S. PATENT DOCUMENTS

| | | | | |
|---|---|---|---|---|
| 2005/0129536 | A1 | 6/2005 | Ohtake | |
| 2010/0034683 | A1 | 2/2010 | Nomura | |
| 2017/0114785 | A1 * | 4/2017 | Eschner | F01C 21/02 |
| 2019/0113034 | A1 | 4/2019 | Podack | |
| 2019/0120231 | A1 | 4/2019 | Obrist et al. | |
| 2021/0180595 | A1 | 6/2021 | Fagerli et al. | |
| 2022/0099093 | A1 * | 3/2022 | Kraft | F04C 29/026 |

FOREIGN PATENT DOCUMENTS

| | | | | |
|---|---|---|---|---|
| DE | 102018217911 | A1 | 4/2020 | |
| EP | 2806165 | A1 * | 11/2014 | F04C 18/0207 |
| JP | 2005163793 | A | 6/2005 | |
| JP | 2006207544 | A | 8/2006 | |
| JP | 2012102741 | A | 5/2012 | |
| JP | 2014040823 | A | 3/2014 | |
| WO | WO-2008020186 | A1 * | 2/2008 | B01D 46/2411 |
| WO | 2020003993 | A1 | 1/2020 | |
| WO | WO-2020025669 | A1 * | 2/2020 | |
| WO | WO-2020038993 | A1 * | 2/2020 | F01C 21/10 |

* cited by examiner

COMPRESSOR MODULE AND ELECTRIC-MOTOR-DRIVEN REFRIGERANT COMPRESSOR

CROSS-REFERENCE TO RELATED APPLICATION

This application is a continuation, under 35 U.S.C. § 120, of copending International Patent Application PCT/EP2021/065911, filed Jun. 14, 2021, which designated the United States; this application also claims the priority, under 35 U.S.C. § 119, of German Patent Application DE 10 2020 207 510.7, filed Jun. 17, 2020; the prior applications are herewith incorporated by reference in their entirety.

FIELD AND BACKGROUND OF THE INVENTION

The invention relates to a compressor module having a compressor housing which has a high-pressure chamber and an outlet for a compressed refrigerant and a separation apparatus which is received therein for separating a lubricant which is mixed with the refrigerant. Furthermore, the invention relates to an electric or electric-motor-driven refrigerant compressor having such a compressor module.

An air-conditioning system of a motor vehicle, by means of which system a vehicle interior can be cooled in the manner of a compression refrigerating machine, has a circuit with a refrigerant, for example, R-134a (1,1,1,2-tetrafluoroethane) or R-774 ($CO_2$), which is guided therein. During operation, the refrigerant is compressed by means of a (refrigerant) condenser or compressor which leads to a pressure and temperature increase of the refrigerant. In particular, the refrigerant compressor is in this instance operated by an electric motor. In the refrigerant compressor and in the (compressor) housing thereof, in the flow direction of the refrigerant a compressor portion and a high-pressure chamber (compression chamber) and a separation apparatus are arranged one behind the other. The compressor portion, which serves to convey the refrigerant from a low-pressure inlet to a high-pressure outlet, is, for example, in the form of a scroll compressor.

During operation of the refrigerant compressor, a lubricant which is introduced therein, in particular oil, is mixed with the gaseous refrigerant. Using the separation apparatus, the lubricant is separated from the refrigerant in the manner of a centrifugal force separator (cyclone separator). To this end, the separation apparatus has an in particular hollow-cylindrical separation chamber (separation portion), in which a separator (separation portion) is received. The admixture (fluid) of lubricant and refrigerant which flows into the separation chamber through an inlet opening of the separation apparatus flows around the separator in a helical manner (cyclone-like manner). In this instance, centrifugal forces act on the admixture of refrigerant and lubricant as a separation mechanism.

International patent disclosure WO 2020/03993 A1 discloses a compressor module which has a pot-like compressor housing having an outlet for a compressed refrigerant and having a separation apparatus which is introduced into a high-pressure chamber of the compressor housing for separating a lubricant which is mixed with the refrigerant. The separation apparatus has a hollow-cylindrical chamber wall which forms a separation chamber which is connected in technical flow terms to the outlet and a separator which is received in the receiving chamber with an annular space being formed.

For torsion-resistant retention, the separator has a radially outwardly protruding retention contour which is received in a corresponding seat of the outlet. In addition, the separator rests with a press-fit being formed in the receiving chamber and consequently in the compressor housing in a non-positive-locking or frictionally engaging manner. It has been found that these measures are not adequate or are not suitable for securing the intended position of the separation apparatus in the compressor housing during compressor operation. The reason for this is that the interference-fit during the compressor operation may, for example, become disengaged as a result of temperature. This can lead to undesirable generation of noise (airborne sound or structure-borne sound) as a result of vibrations and/or impairment of the separation function of the separation apparatus of the compressor module.

SUMMARY OF THE INVENTION

An object of the invention is therefore to provide a particularly suitable compressor module in which a torsion and/or an axial displacement of the separation apparatus in the compressor housing is reliably prevented. Furthermore, an electric-motor-driven refrigerant compressor having such a compressor module is intended to be set out.

With regard to the compressor module, the object is achieved according to the invention with the features of the independent compressor module claim and with regard to the electric-motor-driven refrigerant compressor with the features of the independent compressor claim. The dependent claims relate to advantageous embodiments and developments. In this instance, the statements relating to the compressor module also apply accordingly to the refrigerant compressor and vice versa.

The compressor module has a compressor housing having a high-pressure chamber and having an outlet for a compressed refrigerant and a separation apparatus which is received in the compressor housing for separating a lubricant which is mixed with the refrigerant. The outlet is advantageously in the form of a bore or in the manner of a nozzle, that is to say, an outlet nozzle. The separation apparatus has a hollow-cylindrical separation portion and a funnel-like (conical) outlet portion which protrudes therein with an annular space being formed for the refrigerant.

The separation apparatus rests with a portion end of the separation portion in a receiving member, which is connected to a lubricant reservoir, of the compressor housing. With the outlet portion, the separation apparatus rests in the outlet of the compressor housing. In this instance, the separation apparatus is retained in a positive locking manner in the compressor housing, advantageously exclusively, preferably so as to prevent torsion and/or an axial displacement.

The term "positive-locking" or a "positive-locking connection" between at least two members which are connected to each other is in this instance and below in particular intended to be understood to mean that the cohesion of the members which are connected to each other is carried out at least in one direction by a direct mutual engagement of contours of the members themselves or by means of indirect mutual engagement by means of an additional connection portion. The "blocking" of a mutual movement in this direction is thus carried out as a result of the shape. A positive locking connection is also known as a form-locking connection. A form-locking connection is one that connects two elements together due to the shape of the elements themselves, as opposed to a force-locking connection, which locks the elements together by force external to the elements (e.g. ball and socket).

The separation apparatus preferably contains plastics material. Advantageously, the separation apparatus is in one piece (integral). The funnel-like outlet portion extends with a transition region being formed into the hollow-cylindrical separation portion so that the annular space is formed at that location between the inner wall of the hollow-cylindrical separation portion and the outer wall of the wall portion, which protrudes therein, of the outlet portion. Therein opens an inlet opening which is provided in the outer wall of the separation portion and via which the fluid which contains the refrigerant and lubricant (refrigerant/oil admixture) and which flows into the high-pressure chamber of the compressor module reaches the annular space of the separation apparatus and the lubricant (oil) is separated from the refrigerant therein.

In an advantageous embodiment, the separation apparatus has a number of positive-locking elements which engage in corresponding positive-locking contours of the compressor housing. The term "number of positive-locking elements" is also intended to be understood to be only a (single) positive-locking element which engages in a corresponding positive-locking contour. In other words, the separation apparatus has at least one positive-locking element and the compressor housing has at least one (corresponding) positive-locking contour.

The compressor housing has a housing base and a housing wall. The outlet is introduced into the housing wall, for example, as or in the manner of a bore and/or an outlet nozzle. The outlet which is advantageously in the form of an outlet nozzle advantageously opens in the high-pressure chamber. This chamber is advantageously surrounded by an annular wall, which extends from the housing base in an axial direction of the compressor module and against which a fixed compressor portion, in particular a fixed scroll with the base plate thereof abuts in a sealing manner. The high-pressure chamber is consequently formed in the space delimited by the annular wall and the housing base and the fixed compressor portion.

The preferably at least or exclusively two positive-locking elements are advantageously arranged along the circumference of the outlet portion of the separation apparatus with spacing from each other. In this instance, the positive-locking elements are advantageously positioned in an angular manner symmetrically, in particular at an angle of 90° or preferably 180° relative to each other.

Advantageously, the or each positive-locking element—with respect to the center axis of the separation apparatus—is radially deployed, that is to say, protrudes over the circumference of the outlet and/or the separation portion. In this instance, the respective positive-locking element is radially deployed in order, when the separation apparatus is inserted into the compressor housing, to engage at the position of the housing-side positive-locking contour therein in the manner of a snap-fitting connection. The snap-fitting connection may be configured to be non-releasable or also releasable, for which purpose the positive-locking elements are constructed accordingly. In a particularly advantageous manner, the respective positive-locking contour forms for the positive-locking element a tangential stop as a torsion prevention member of the separation apparatus in the compressor housing and/or an axial stop for securing the separation apparatus against axial displacement in the compressor housing.

In an advantageous embodiment, one of the positive-locking contours is in the form of a radial groove. Advantageously, an additional one of the positive-locking contours is in the form of an axial groove. In a particularly advantageous manner, at least one of the positive-locking contours is in the form of a tangential stop for the corresponding positive-locking element and consequently of a torsion prevention member of the separation apparatus in the compressor housing.

Additionally or alternatively, the receiving member, which is connected to the lubricant reservoir, of the compressor housing acts as an axial stop for the separation apparatus. To this end, the receiving member is advantageously constructed as or in the manner of a stepped bore so as to form a preferably annular abutment step on/against which the separation apparatus is supported at the free end with the separation portion thereof or is in abutment.

In an advantageous embodiment, radial support webs are formed on the outlet portion of the separation apparatus at the outer side and—with respect to the center axis of the separation apparatus. These webs serve to prevent tilting of the separation apparatus in the compressor housing and in this instance in particular in the region of the outlet or outlet nozzle. Advantageously, the radial support webs are in alignment with the outer circumference of the (hollow) cylindrical separation portion of the separation apparatus. In other words, the outer diameter of the (cylindrical) separation portion and that of the (funnel-like) outlet portion are identical in the region of the radial support webs.

Advantageously, the or each positive-locking element is arranged along one of the radial support webs and/or is formed therefrom. In other words, the radial support webs along which one of the positive-locking elements is arranged, with respect to the center axis of the separation apparatus, are axially shortened so as to form a web-free axial portion in which the respective positive-locking element is arranged. This element thus performs a dual function, that is to say, that of a snap-fitting element for the positive-locking connection and a support function against tilting of the separation apparatus in the compressor housing.

In a particularly advantageous embodiment, the respective positive-locking element is formed at the transition of the funnel-like outlet portion in the (hollow) cylindrical outlet portion with a fixed end being formed. In this instance, the positive-locking element extends from the fixed end thereof along the conically expanding funnel-like outlet portion in the direction of the outlet-side end portion thereof, at least partially without abutment. In other words, the loose end of the positive-locking element extends with spacing or with a gap being formed along the funnel-like or conical outlet portion of the separation apparatus.

According to an advantageous embodiment, in the high-pressure chamber, preferably in a housing or wall region of the compressor housing adjacent to the outlet, a housing wall which extends axially with respect to the center axis of the separation apparatus is provided. This wall is advantageously constructed in the manner of a half-shell which engages partially around the outlet portion of the separation apparatus, that is to say, over a portion of the circumference thereof. In this housing wall, the respective positive-locking contour is advantageously introduced as a radial or axial groove. These grooves extend radially or axially in the housing wall and open in the high-pressure chamber and are therefore open relative thereto. The radial groove acting as a positive-locking contour advantageously forms both the tangential stop and an axial stop for the positive-locking element and via this for the separation apparatus in the compressor housing. The axial groove acting as a positive-locking contour advantageously also forms such a tangential stop or is in the form of such a stop.

In an advantageous development, an electrical (electric-motor-driven) refrigerant compressor for compressing a refrigerant, in particular of a motor vehicle, has such a compressor module. In addition, the electric-motor-driven refrigerant compressor has a motor module having the electric motor. In this instance, a compressor portion, which is advantageously in the form of a scroll compressor which operates in the manner of a positive-displacement pump, is supported in the compressor housing, wherein a movable scroll portion (movable scroll) is driven in an orbiting manner with respect to a fixed scroll portion (fixed scroll), in particular by means of an electric motor, and in this instance the refrigerant is compressed.

The scrolls are in the form of a helical pair or scroll pair which are fitted one inside the other, wherein one of the helixes is fixed with respect to the compressor housing and engages at least partially in a second helix which is driven in an orbiting manner by means of an electric motor. An orbiting movement is in this instance intended in particular to be understood to be an eccentric circular movement path in which the movable scroll itself does not rotate about its own axis. There are thereby formed with each orbiting movement between the helixes two or more substantially sickle-like refrigerant chambers whose volumes decrease (are compressed) during the movement. The compressed refrigerant is discharged into the high-pressure chamber via an outlet in the fixed scroll portion.

Other features which are considered as characteristic for the invention are set forth in the appended claims.

Although the invention is illustrated and described herein as embodied in a compressor module and an electric-motor-driven refrigerant compressor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
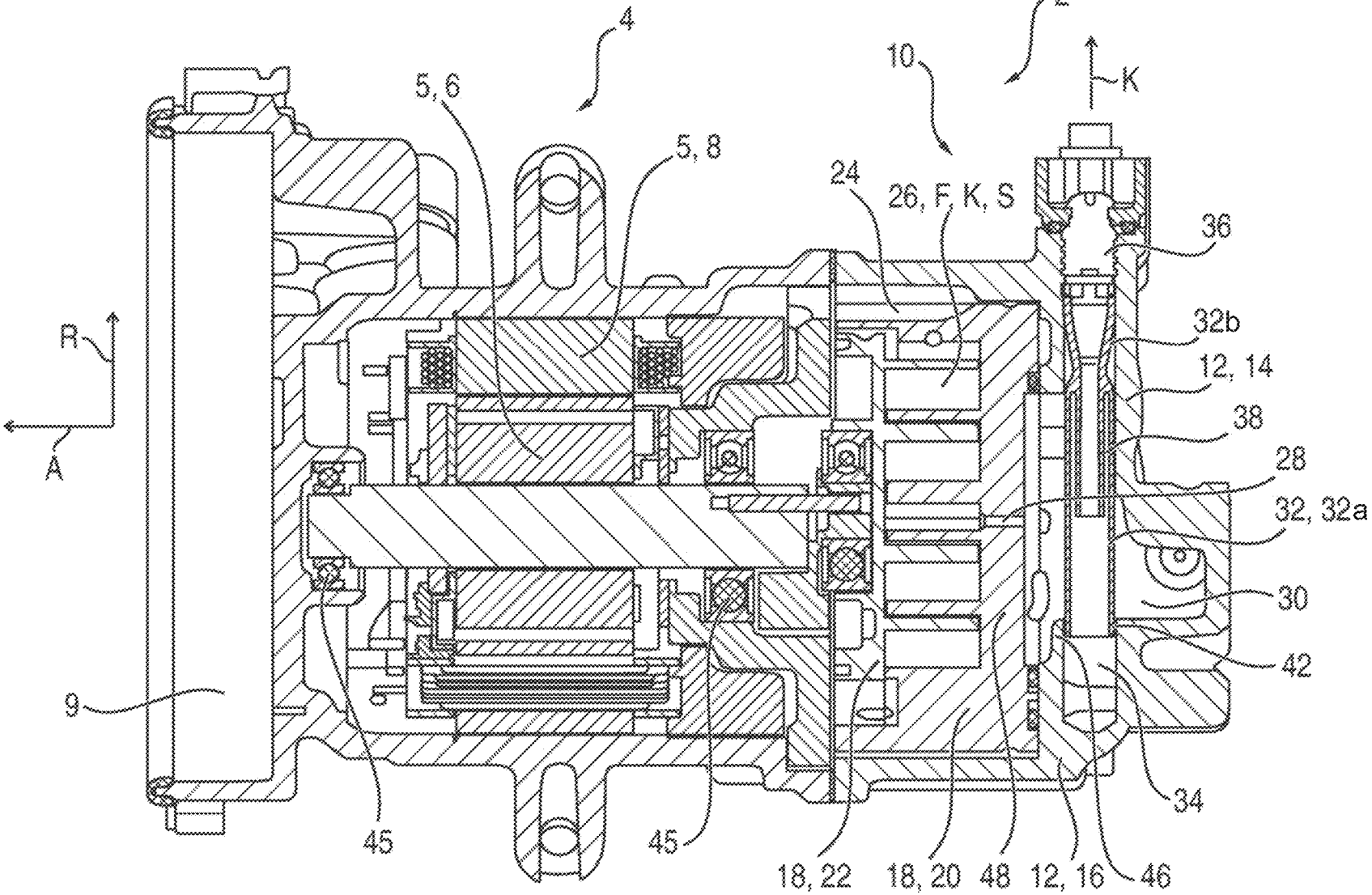
FIG. 1 is a diagrammatic, longitudinal sectional view of an electric-motor-driven refrigerant compressor having a motor module which has an electric motor and having a compressor module, wherein a separation apparatus for separating a lubricant from a refrigerant is arranged in a high-pressure chamber of the compressor housing thereof.

Components and variables which correspond to each other are given the same reference numerals in all the figures.

Referring now to the figures of the drawings in detail and first, particularly to FIG. 1 thereof, there is shown an electric-motor driven compressor 2 or can be constructed as an electric-motor-driven refrigerant compressor in a refrigerant circuit (not illustrated in greater detail) of an air-conditioning system of a motor vehicle. The compressor 2 is constructed in a modular manner and has a motor module 4 having an electric motor 5 which in turn includes a rotor 6 and a stator 8. In addition, the compressor 2 has an electronics compartment 9 which receives an electronic unit which is not illustrated in greater detail for controlling the electric motor 5. Furthermore, the compressor 2 has a compressor module 10 which is connected to the motor module 4.

The compressor module 10 has a substantially pot-like compressor housing 12 having a housing base 14 and having a housing wall 16. In the compressor housing 12, a compressor portion 18 which is in the form of a scroll compressor here and which is drivingly connected to the electric motor 5 of the motor module 4 is supported. The compressor portion 18 has a first, compressor portion element (a fixed scroll) 20 which is fixed with respect to the compressor housing 12 and a second movable compressor portion element (a movable scroll) 22 which engages therein.

Within the compressor 2, there is provided a lubricant S which serves to lubricate the compressor portion 18 and which performs a sealing function so that between the compressor portion elements (scrolls) 20 and 22 leaks are prevented. As a result of operation, a refrigerant K which is compressed by means of the compressor portion 18 and the lubricant S are mixed in this case. The refrigerant K flows at the low-pressure side of the compressor portion 18 through a compressor portion inlet 24 into a compressor portion chamber 26. At that location, the admixture or fluid F containing the refrigerant K and lubricant S is condensed (compressed), wherein the compressor portion 18 acts in the manner of a positive-displacement pump. Subsequently, the admixture F flows out of the compressor portion 18 through a high-pressure-side compressor portion outlet 28 into a high-pressure chamber 30 of the compressor housing 12.

The radial direction with respect to the compressor housing 12 and the axial direction perpendicularly to the housing base 14 in the direction of the compressor portion 18 are designated R or A in the adjacent directional diagram.

Figure 2:
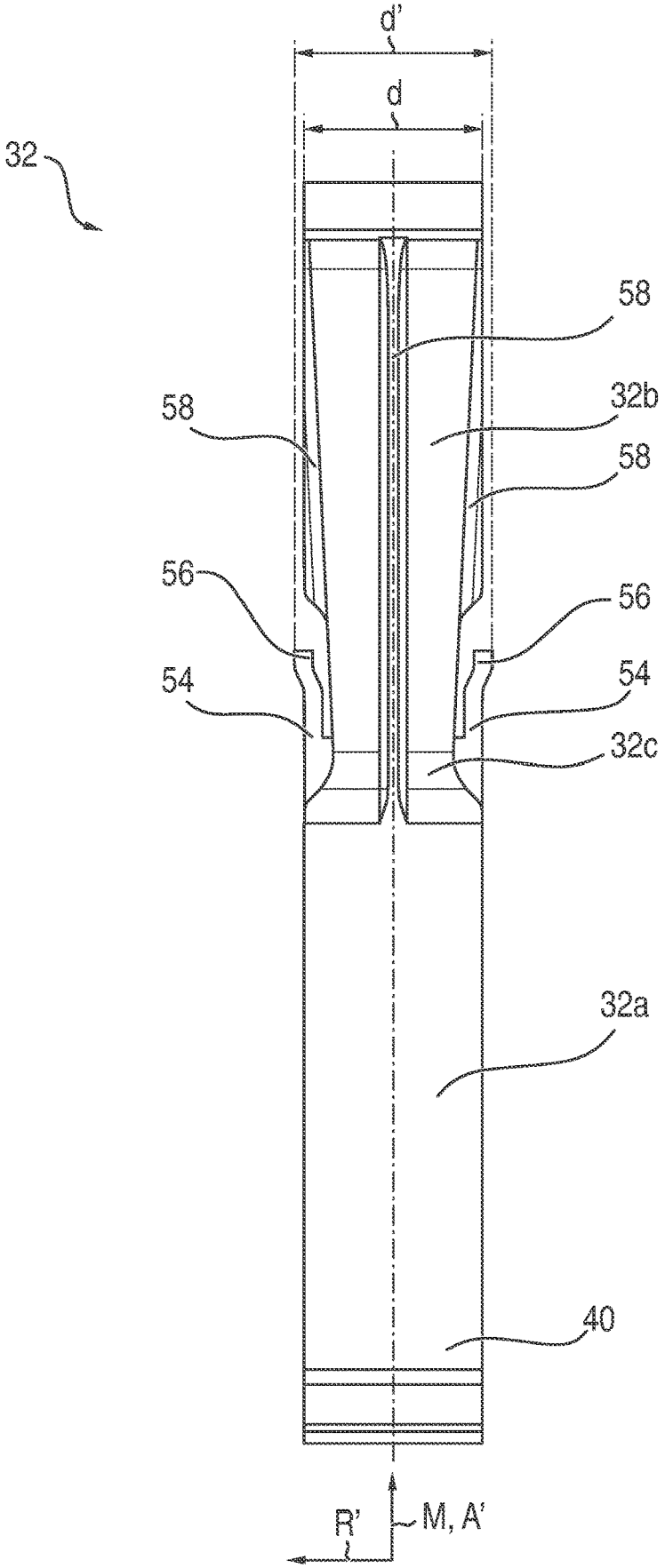
FIG. 2 is a side view of the separation apparatus having a cylindrical separation portion and having a funnel-like outlet portion for the separated refrigerant and having two locking-hook-like positive-locking elements in the region of the transition between the separation and outlet portion.
Figure 3:
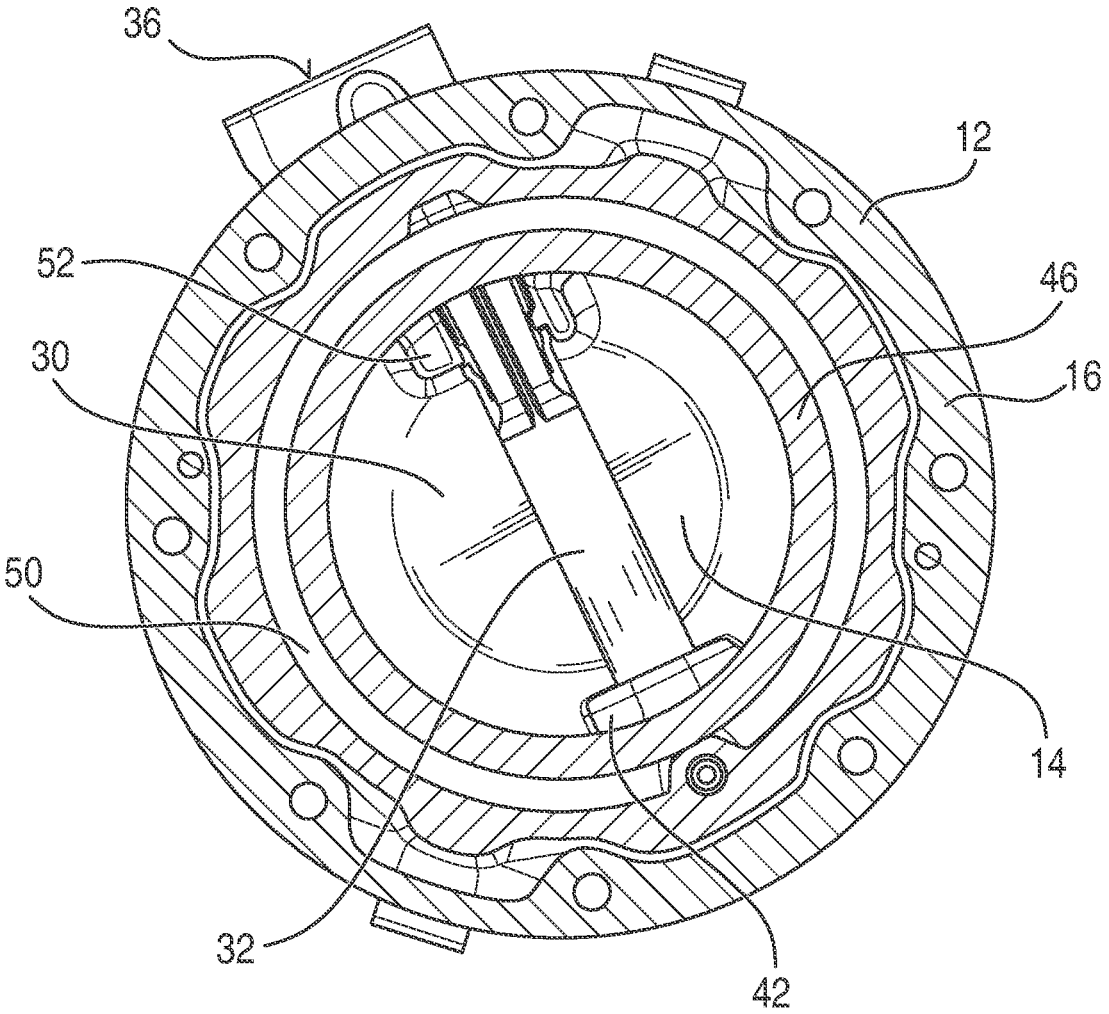
FIG. 3 is a cross-sectional view of the compressor housing with the separation apparatus resting therein in a positive-locking manner.
Figure 4:
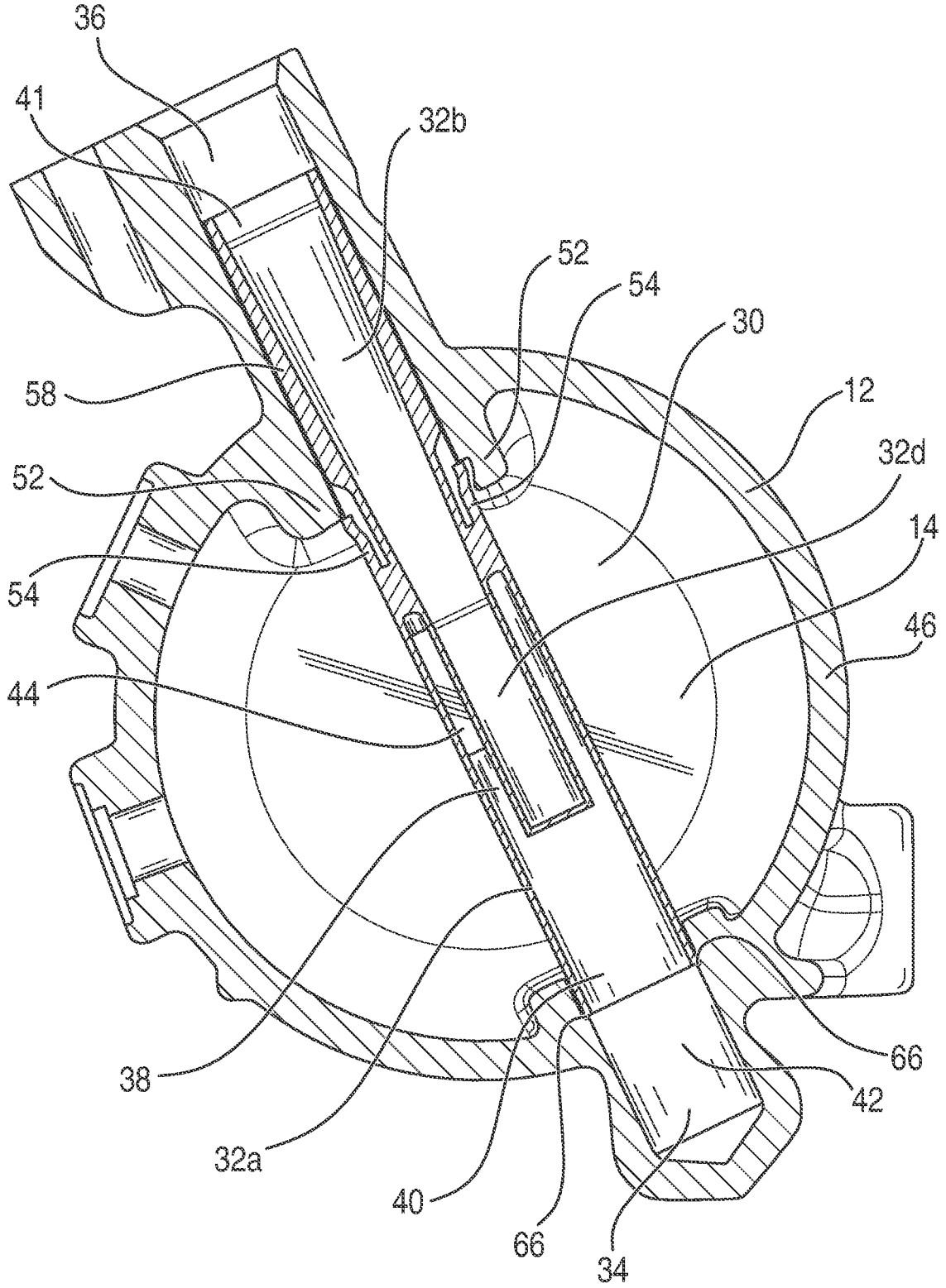
FIG. 4 is a cross-sectional view of the compressor housing according to FIG. 3 having a positive-locking snap-fitting connection between the positive-locking elements of the separation apparatus and corresponding positive-locking contours in a housing wall of the compressor housing.

A separation apparatus 32 which is illustrated in FIGS. 2 to 4 in a comparatively detailed manner is introduced into the high-pressure chamber 30. The center axis M of the separation apparatus 32—and consequently the axial direction A' and radial direction R' thereof—is with respect to the compressor 2 according to FIG. 1 or the compressor housing 12 thereof orientated in the radial direction R thereof. The separation apparatus 32 serves to separate the lubricant S which is mixed with the refrigerant K in a lubricant reservoir 34 in the manner of a centrifugal force separator. The housing wall 16 has a nozzle-like or bore-like outlet 36 through which the refrigerant K which is separated from the lubricant S flows away into the refrigerant circuit, which is indicated with the arrow designated K.

The separation apparatus 32 has a hollow-cylindrical separation portion 32*a* and a funnel-like outlet portion 32*b*, which protrudes therein with an annular space 38 being formed, for the refrigerant K. The separation apparatus 32 rests with a separation portion end 40 of the separation portion 32*a* in a (housing-side) receiving member 42 of the compressor housing 12 which is connected to the lubricant reservoir 34. With an outlet-side portion end 41 of the outlet portion 32*b*, the separation apparatus rests in the outlet (outlet nozzle, outlet bore) 36 of the compressor housing 12 (FIG. 4). In this instance, the separation apparatus 32 is retained in the compressor housing 12, preferably only or exclusively in a positive-locking manner.

As can be seen comparatively clearly in FIGS. 2 and 3, the separation apparatus 32 is constructed in one piece. In other words, the separation apparatus 32*a* and the outlet portion 32*b* are constructed in a coherent (monolithic) manner. The separation apparatus 32 is, for example, produced by means of an injection-molding method as a plastics material insertion component for plug-in assembly. The funnel-like or conical outlet portion 32*b* extends with a transition region 32*c* being formed into the hollow-cylindrical separation portion 32*a*. In this instance, the annular space 38 is formed between the inner wall of the hollow-cylindrical separation portion 32*a* and the outer wall of the wall part (wall portion) 32*d*, which protrudes into the separation portion 32*a*, of the outlet portion 32*b*. There opens therein an inlet opening 44 which is elongate-hole-like in the embodiment (FIG. 4) and which is provided in the outer wall of the separation portion 32*a* and via which the fluid F which comprises refrigerant K and lubricant (refrigerant/oil admixture) S and which flows into the high-pressure chamber 30 of the compressor module 12 reaches the annular space 38 of the separation apparatus 32, by means of which the lubricant (oil) S is separated from the refrigerant K.

The fluid F which flows via an inlet opening 44 into the separation apparatus 32 flows around helically (in the manner of a cyclone) the wall portion 32*d* of the separation apparatus 32 in the direction of the lubricant reservoir 34, wherein the centrifugal force acting on the refrigerant K which is contained in the fluid F and the lubricant S which is contained in the fluid F acts as a separation mechanism. Subsequently, the refrigerant K which has been separated from the lubricant S flows away through the outlet portion 32*b* and via the outlet 36 into the refrigerant circuit. The separated lubricant S is returned in a manner not illustrated in greater detail to the fixed scroll 20 and to bearings (roller or ball bearings) 45 of the electric motor 5 in order to lubricate and/or cool them.

According to FIGS. 3 and 4, the compressor housing 12 has an annular wall 46 on which the fixed scroll 20 rests in a sealing manner. The inner annular region, which is delimited by the annular wall 46 and the housing base 14 and a base plate 48 (FIG. 1) of the fixed scroll 20 forms the high-pressure chamber 30 of the compressor module 10. Between the inner annular wall 46 and the (outer) housing wall 16 of the compressor housing 12 an annular housing space 50 is formed.

Figure 5:
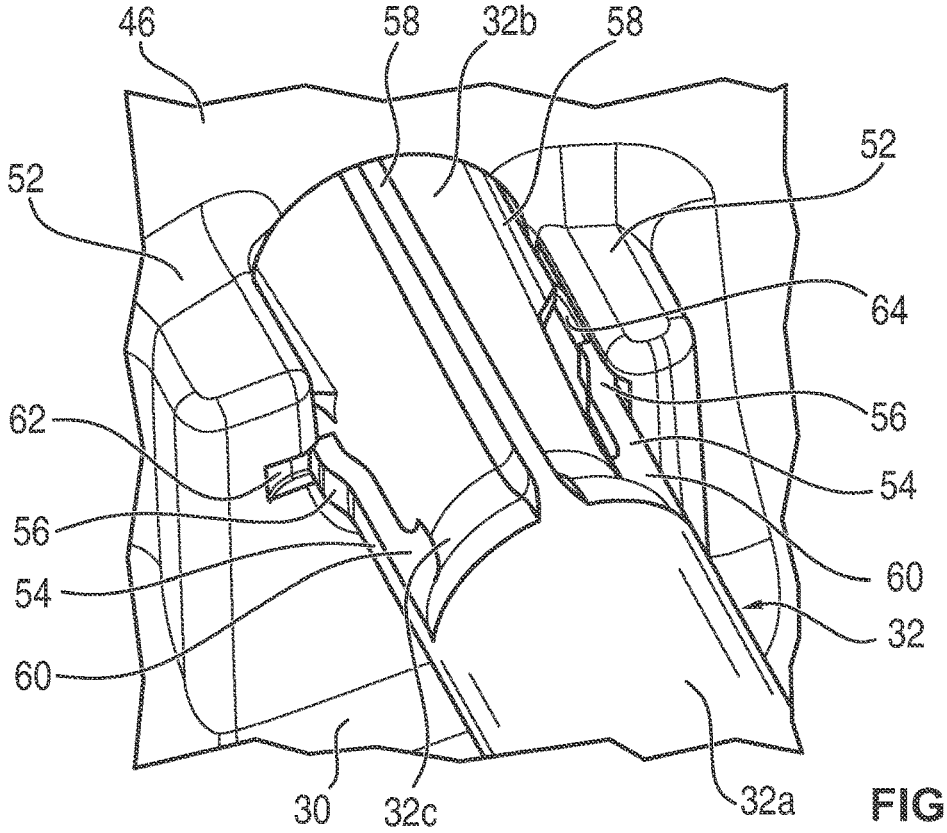
FIG. 5 is a perspective view of an enlarged cut-out from FIG. 3 in a region of the snap-fitting connection.
Figure 6:
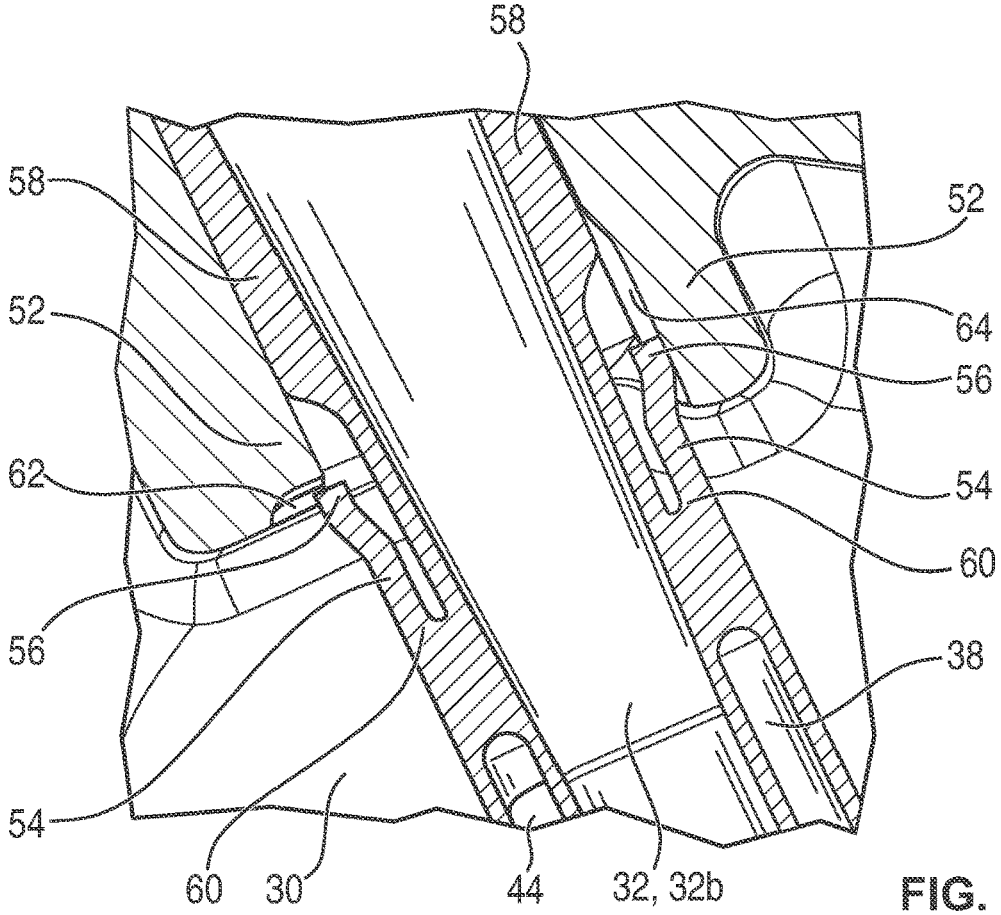
FIG. 6 is a sectional view of an enlarged cut-out from FIG. 4 in the region of the snap-fit connection.

As can further be seen comparatively clearly in FIGS. 5 and 6, there is provided in the compressor housing 12 a housing wall 52 which adjoins the outlet 36 and—with respect to the center axis M (FIG. 2) of the separation apparatus 32—extends axially (in the axial direction A') into the high-pressure chamber 30. The housing wall 52 is formed on the annular wall 46 and on the housing base 14 of the compressor housing 12 or is formed therefrom. The housing wall 52 is constructed in the manner of a half-shell (FIG. 4) which engages around the outlet portion 32*b* of the separation apparatus 32 over a portion of the circumference thereof.

According to FIG. 2, the separation apparatus 32 has a number of positive-locking elements 54. In the embodiment, two such positive-locking elements 54 are positioned along the circumference of the outlet portion 32*b* of the separation apparatus 32 with spacing from each other at an angle of 180°. The positive-locking elements 54 are in the form of locking or snap-fitting hooks with radially (with respect to the center axis M of the separation apparatus 32 in the radial direction R') deployed hook ends 56 which protrude beyond the circumference of the outlet portion 32*b*. In other words, the (outer) diameter d' of the separation apparatus 32 in the region of the radially deployed hook ends 56 of the positive-locking elements 54 is greater than the (outer) diameter d of the separation apparatus 32 along the axial direction A' thereof between the separation-side portion end 40 and the outlet-side portion end 41.

As can also be seen in FIGS. 5 and 6, radial support webs 58 are formed on the outlet portion 32*b* of the separation apparatus 32 at the outer side with respect to the center axis M of the separation apparatus 32. In the embodiment, four such support webs 58 are provided offset from each other through 90° in each case. The support webs 58 are in alignment with the outer circumference (outer diameter d) of the separation portion 32*a* and supplement the funnel-like outlet portion 32*b* to form the outer diameter d of the separation portion 32*a* of the separation apparatus 32. The support webs 58 serve to prevent tilting of the separation apparatus 32 in the region of the outlet or outlet nozzle 36 of the compressor housing 12.

The respective positive-locking element 54 is arranged along one of the radial support webs 58. In this instance, those radial support webs 58, along which the respective positive-locking element 54 is arranged, are axially shortened with respect to the center axis M of the separation apparatus 32 so as to form a web-free axial portion along which the respective positive-locking element 54 extends axially (in an axial direction A'). The respective positive-locking element 54 is formed in the transition portion 32*c* in which the funnel-like outlet portion 32*b* merges into the (hollow) cylindrical separation portion with a fixed end 60 being formed. In this instance, the positive-locking element 54 extends from the fixed end 60 thereof at the transition portion 32*c* along the conically expanding outlet portion 32*b* in the direction of the outlet-side portion end 41 thereof without any abutment. In other words, the loose end of the positive-locking element 54 extends with the hook end 56 which is in the form of a locking or snap-fitting hook with spacing or with a gap being formed along the funnel-like or conical outlet portion 32*b* of the separation apparatus 32.

The positive-locking elements 54 engage in corresponding positive-locking contours 62, 64 of the compressor housing 12. The positive-locking contour 62 is in the form of a radial groove. This groove extends in the housing wall 52 radially, that is to say, with respect to the center axis M of the separation apparatus 32 in a radial direction R', and opens into the high-pressure chamber 30, that is to say, is open relative thereto. The positive-locking contour 64 is in the form of an axial groove. This groove extends axially in the housing wall 52, that is to say, with respect to the center axis M of the separation apparatus 32 in an axial direction A' and opens in the high-pressure chamber 30, that is to say, is open relative thereto.

In the embodiment, both positive-locking contours 62, 64 are in the form of a tangential stop for the corresponding positive-locking element 54. In addition, in the embodiment, the receiving member 42, which is connected to the lubricant reservoir 34, of the compressor housing 12 acts as al an axial stop for the separation apparatus 32. To this end, the receiving member 42 is configured in the manner of a stepped bore with an annular abutment step 66 on which the separation apparatus 32 is supported with the separation-side portion end 41 thereof being formed.

When the separation apparatus 32 is inserted via the outlet 36 into the compressor housing 12, the positive-locking elements 54 engage with the hook ends 56 thereof in the housing-side positive-locking contours 62, 64 in the manner of a snap-fitting connection. In this instance, the positive-locking contours 62, 64 and where applicable the abutment step 66 form the tangential stop as a torsion prevention member of the separation apparatus 32 and the axial stop for securing the separation apparatus 32 against axial displacement in the compressor housing 12. By means of the snap-fitting connection between the separation-side positive-locking elements 54 and the corresponding housing-side positive-locking contours 62, 64, the separation apparatus 32 is retained in the compressor housing 12 in a positive-locking manner and in this instance secured against torsion and axial displacement. An additional non-positive-locking or frictionally engaging connection is not required and preferably also not provided.

Figure 7:
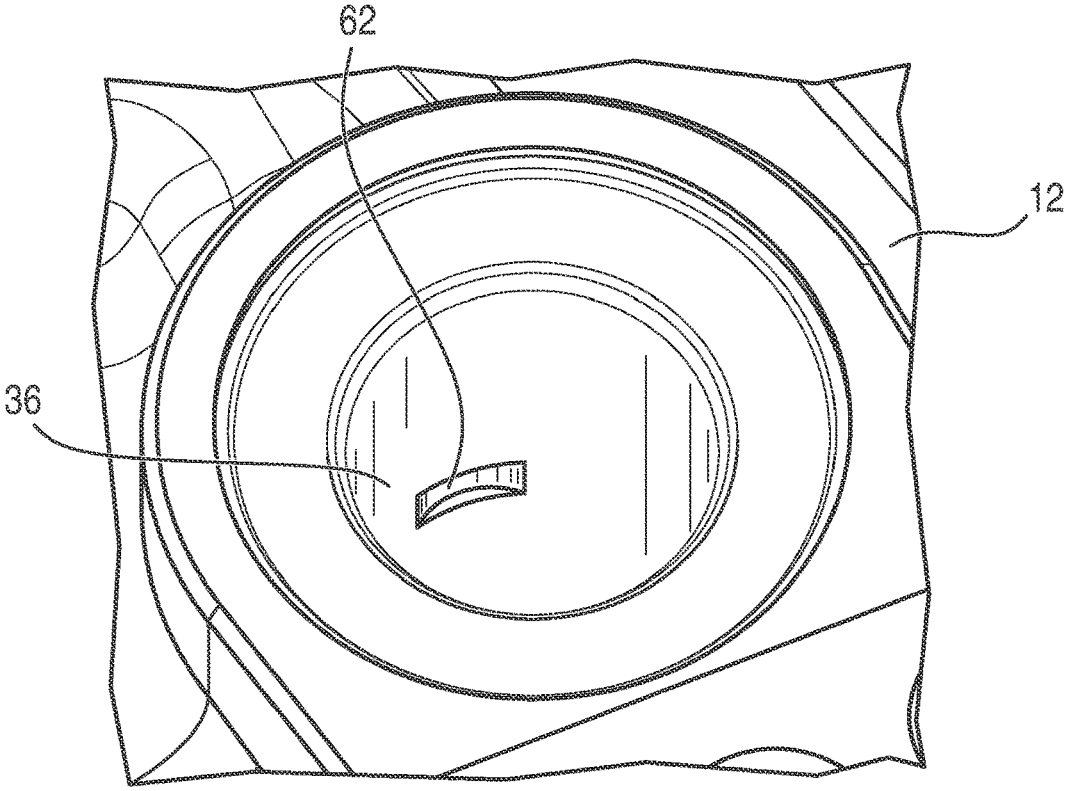
FIG. 7 is a perspective view as a cut-out of the compressor housing in the region of a nozzle-like outlet with a radial groove introduced therein as a positive-locking contour with an axial and tangential stop for a locking-projection-like positive-locking element at the free end of the outlet portion of a variant of the separation apparatus.
Figure 8:
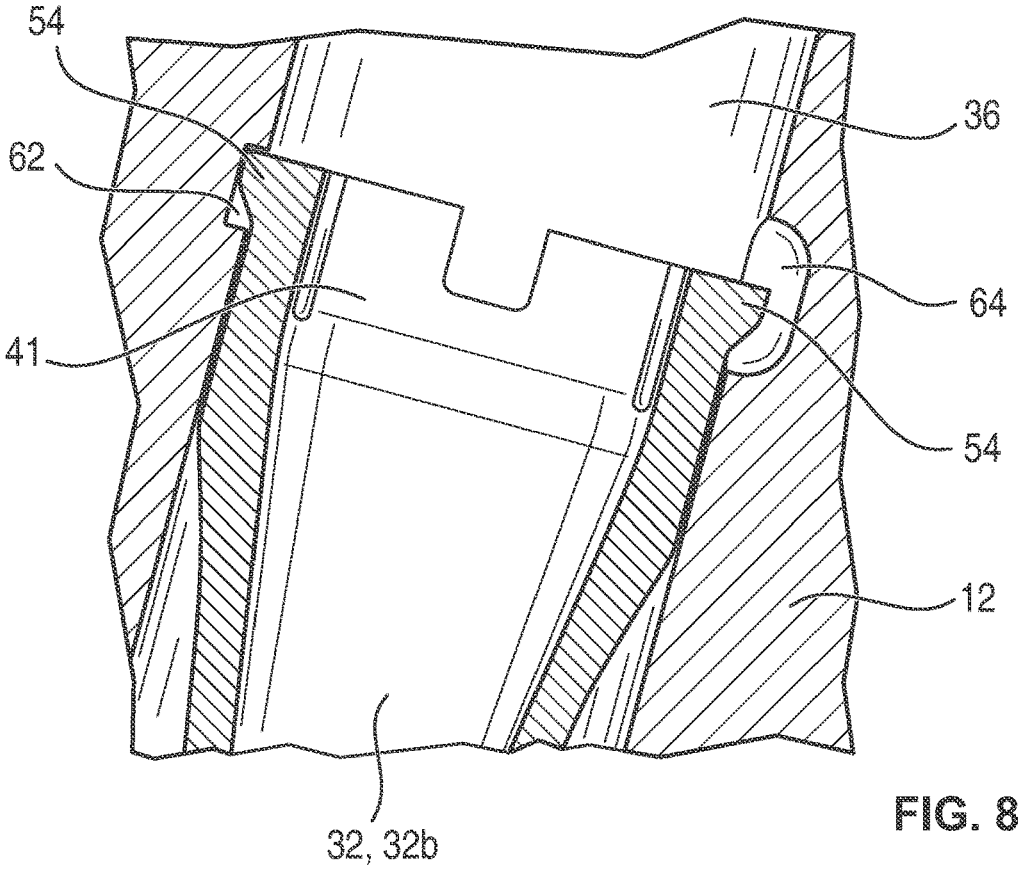
FIG. 8 is a cross-sectional view as a cut-out of the positive-locking snap-fitting connection between the positive-locking element of the separation apparatus and the radial groove and an axial groove as an additional positive-locking contour in the outlet for a second positive-locking element of the variant of the separation apparatus.

FIGS. 7 and 8 show a variant of the separation apparatus 32 and the positive-locking, again releasable or non-releasable snap-fitting connection thereof in the compressor housing 12. In this instance, the separation apparatus 32 has at the outlet side portion end 41 radially—that is to say, in the radial direction R'—deployed locking elements or snap-fitting hooks as positive-locking elements 54. These elements are positioned at the circumferential side of the separation apparatus 32 at the end side of the outlet portion 32*b* again offset through 180°. The corresponding positive-locking contours 62, 64 which are arranged in the outlet 36 which is again constructed in the manner of a nozzle or as a bore are again in the form of a radial groove or an axial groove with a tangential stop.

The claimed invention is not limited to the embodiments described above. Instead, other variants of the invention can also be derived therefrom by the person skilled in the art in the context of the disclosed claims, without departing from the subject-matter of the claimed invention. In particular, all the individual features which have been described in connection with the various embodiments in the context of the disclosed claims can also be combined in other manners without departing from the subject-matter of the claimed invention.

The following is a summary list of reference numerals and the corresponding structure used in the above description of the invention.

LIST OF REFERENCE NUMERALS

2 Refrigerant/compressor
4 Motor module
5 Electric motor
6 Rotor
8 Stator
9 Electronics compartment
10 Compressor module
12 Compressor housing
14 Housing base
16 Housing wall
18 Compressor portion
20 Fixed compressor portion element/scroll
22 Movable compressor element/scroll
24 Compressor portion inlet
26 Compressor portion chamber
28 Compressor portion outlet
30 High-pressure chamber
32 Separation apparatus
32*a* Separation portion
32*b* Outlet portion
32*c* Transition region
32*d* Wall part/wall portion
34 Lubricant reservoir
36 Outlet/outlet nozzle
38 Annular space
40 Separation-side portion end
41 Outlet-side portion end
42 Receiving member
44 Inlet opening
45 Bearing
46 Annular wall
48 Base plate
50 Annular housing space
52 Housing wall
54 Positive-locking element
54*a* Fixed end
56 Hook end
58 Support web
60 Fixed end
62 Positive-locking contour/radial groove
64 Positive-locking contour/axial groove
66 Abutment step
A Axial direction (compressor)
A' Axial direction (separation apparatus)
F Admixture/fluid
K Refrigerant
M Center axis
R Radial direction (compressor)
R' Radial direction (separation apparatus)
S Lubricant/oil
d, d' (Outer) diameter

The invention claimed is:

1. A compressor module, comprising:

a compressor housing having a high-pressure chamber and an outlet for a compressed refrigerant and a separation apparatus being received in said high-pressure chamber for separating a lubricant being mixed with the refrigerant, said compressor housing further having a receiving member, said separation apparatus having a hollow-cylindrical separation portion and a funnel-shaped outlet portion protruding therein with an annular space being formed for the refrigerant, said compressor housing further having a plurality of form-locking contours and a housing wall, at least one of said form-locking contours is provided in said housing wall which adjoins said outlet and which protrudes into said high-pressure chamber;

a lubricant reservoir connected to said receiving member, said separation apparatus resting with a portion end of said hollow-cylindrical separation portion in said receiving member, and with said funnel-shaped outlet portion at least partially in said outlet; and said separation apparatus being securely retained in said compressor housing by means of a form-locking connection so as to prevent torsion and/or axial displacement, said separation apparatus having in a region of said funnel-shaped outlet portion a plurality of form-locking elements which engage in corresponding ones of said form-locking contours formed in said compressor housing.

2. The compressor module according to claim 1, wherein said form-locking connection is produced by means of a snap-fitting connection.

3. The compressor module according to claim 1, wherein said form-locking elements are disposed with spacing from each other along a circumference of said funnel-shaped outlet portion of said separation apparatus.

4. The compressor module according to claim 3, wherein said form-locking elements are disposed at said spacing from each other along the circumference of said outlet portion at an angle of 180°.

5. The compressor module according to claim 1, wherein at least one of said form-locking elements is radially deployed with respect to a center axis of said separation apparatus and protrudes over a circumference of said funnel-shaped outlet portion and/or said separation portion.

6. The compressor module according to claim 5, further comprising radial support webs formed on said funnel-shaped outlet portion of said separation apparatus at an outer side with respect to a center axis, and at least one of said form-locking elements is disposed along one of said radial support webs and/or is formed therefrom.

7. The compressor module according to claim 1, wherein said housing wall engages partially around said outlet portion of said separation apparatus.

8. The compressor module according to claim 7, wherein said housing wall engages partially around said funnel-shaped outlet portion of said separation apparatus in a manner of a half-shell.

9. The compressor module according to claim 1, wherein:

one of said form-locking contours is in a form of a radial groove; and/or one of said form-locking contours is in a form of an axial groove; and/or at least one of said form-locking contours is in a form of a tangential stop and/or an axial stop for a corresponding one of said form-locking elements or acts as such a stop.

10. The compressor module according to claim 1, wherein said receiving member of said compressor housing, which is connected to said lubricant reservoir, is formed as an axial stop for said separation apparatus.

11. The compressor module according to claim 10, wherein said receiving member is formed with an abutment step.

12. An electric-motor-driven refrigerant compressor for compressing a refrigerant of a motor vehicle, comprising:

said compressor module according to claim 1; and a motor module having an electric motor.

* * * * *